US010221550B2

(12) United States Patent
Colacino

(10) Patent No.: US 10,221,550 B2
(45) **Date of Patent: *Mar. 5, 2019**

(54) DRAIN COVER ASSEMBLY

(71) Applicant: Jarrod Colacino, East Rockaway, NY (US)

(72) Inventor: Jarrod Colacino, East Rockaway, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/488,707

(22) Filed: Apr. 17, 2017

(65) Prior Publication Data

US 2017/0218611 A1 Aug. 3, 2017

Related U.S. Application Data

(63) Continuation of application No. 14/322,228, filed on Jul. 2, 2014, now Pat. No. 9,624,656.

(51) Int. Cl.

| | |
|---|---|
| ***E03C 1/262*** | (2006.01) |
| ***E03C 1/23*** | (2006.01) |
| ***E03C 1/26*** | (2006.01) |
| ***E03C 1/264*** | (2006.01) |

(52) U.S. Cl.

CPC ..... *E03C 1/262* (2013.01); *E03C 1/23* (2013.01); *E03C 1/2302* (2013.01); *E03C 1/26* (2013.01); *E03C 1/264* (2013.01)

(58) Field of Classification Search

CPC . E03C 1/23; E03C 1/2302; E03C 1/26; E03C 1/262; E03C 1/264; A47K 1/14

USPC ..... 4/286, 287, 290–293

See application file for complete search history.

(56) References Cited

U.S. PATENT DOCUMENTS

| | | | | |
|---|---|---|---|---|
| 2,220,772 | A * | 11/1940 | Millard | B01D 29/35 4/291 |
| 2,528,919 | A | 11/1950 | Stone | |
| 3,742,524 | A | 7/1973 | Ballentine | |
| 4,188,676 | A | 2/1980 | Tolnai et al. | |
| 6,023,795 | A | 2/2000 | Potter et al. | |
| 6,108,828 | A | 8/2000 | Cheng | |
| 6,173,455 | B1 | 1/2001 | Nordstrom | |
| 6,263,518 | B1 | 7/2001 | Magtanong | |
| 6,387,261 | B1 | 5/2002 | Mojena | |
| 7,670,360 | B2 | 3/2010 | Catbagan et al. | |
| 7,975,323 | B2 | 7/2011 | Dees | |
| 2007/0090042 | A1 | 4/2007 | Capper | |
| 2009/0094766 | A1 * | 4/2009 | Dombrowski | E03C 1/264 15/105 |
| 2011/0126347 | A1 | 6/2011 | Qian et al. | |
| 2011/0310862 | A9 | 12/2011 | Doyle et al. | |
| 2012/0255117 | A1 | 10/2012 | Childs et al. | |
| 2014/0310862 | A1 * | 10/2014 | Joseph | E03C 1/262 4/287 |

* cited by examiner

*Primary Examiner* — J. Casimer Jacyna

(74) *Attorney, Agent, or Firm* — Schiff Hardin LLP

(57) ABSTRACT

A drain cover assembly is disclosed. The drain cover assembly includes a drain cover having a top portion and a bottom portion that has an outer threading and a plurality of openings. The drain cover assembly further includes a cylindrical or frustoconical basket having a rigid structure. The basket is configured to be completely immersed in a drainage pipe. The basket includes a top portion that is configured to be threadably coupled to the bottom portion of the drain cover. The basket further includes a bottom portion configured to allow liquid to seep through but not solid material.

23 Claims, 5 Drawing Sheets

DRAIN COVER ASSEMBLY

CROSS-REFERENCES TO RELATED APPLICATIONS

The present application is a continuation application of U.S. patent application Ser. No. 14/322,228, filed Jul. 2, 2014, entitled "Drain Cover Assembly," now U.S. Pat. No. 9,624,656, issued Apr. 18, 2017, which claims the benefit of U.S. Provisional Patent Application Ser. No. 61/860,145, filed on Jul. 30, 2013. Each of these applications is incorporated herein by reference in its entirety.

BACKGROUND

Drain covers for bathroom sinks and tubs are generally used to stop liquid from seeping through the drainage pipe when the drain cover is in a closed position. When the drain cover is opened, sink contents can drain around the periphery of the drain cover through the sink hole to the drainage pipe. Since the gap between the sink hole and the drain cover is relatively large (typically 0.5 cm or larger), sink contents that penetrate through the sink hole are not limited to water, but may include debris such as hair, soap-scum, and other particles that may ultimately clog the drainage pipe.

In many designs, the drain cover is opened and closed by a user pushing/pulling an external push rod located next to the sink faucet. The external push rod is mechanically coupled to an internal rod that is configured to push up/down the drain cover through the drainage pipe. One concern with such a rod assembly is that the internal rod may catch at least some of the debris that goes through the sink hole. While mechanical filters that catch debris before it enters the drainage pipe through the sink hole are known, they have several concerns. Debris that is caught by known filters is readily visible to a user of the sink, thereby rendering such filters aesthetically unappealing. Further, known filters typically interfere with the operation of the push rod assembly to open and close the drain cover, thereby preventing a water tight seal of the sink.

Accordingly, it would be beneficial to have a drain cover assembly that prevents the clogging of a drainage pipe while not immediately revealing any caught debris. It would also beneficial to have a drain cover assembly that is in harmony with the push rod assembly.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples in order to provide a thorough understanding of the relevant teachings. However, it should be apparent that the present teachings may be practiced without such details. In other instances, well-known methods, procedures, components, and/or devices have been described at a relatively high-level, without detail, in order to avoid unnecessarily obscuring unique aspects of the present teachings.

The various examples discussed below generally relate to a drain cover assembly for a sink or tub, and more specifically, to a drain cover that is configured to catch debris. In various embodiments, the drain cover assembly can be placed in most drains to allow liquid to seep through but not any solid material. The debris captured by the drain cover assembly is not immediately visible to a user of the drain. Further, in one implementation, the drain cover assembly is compatible with existing rod assemblies to open and seal the drainage pipe.

Figure 1:
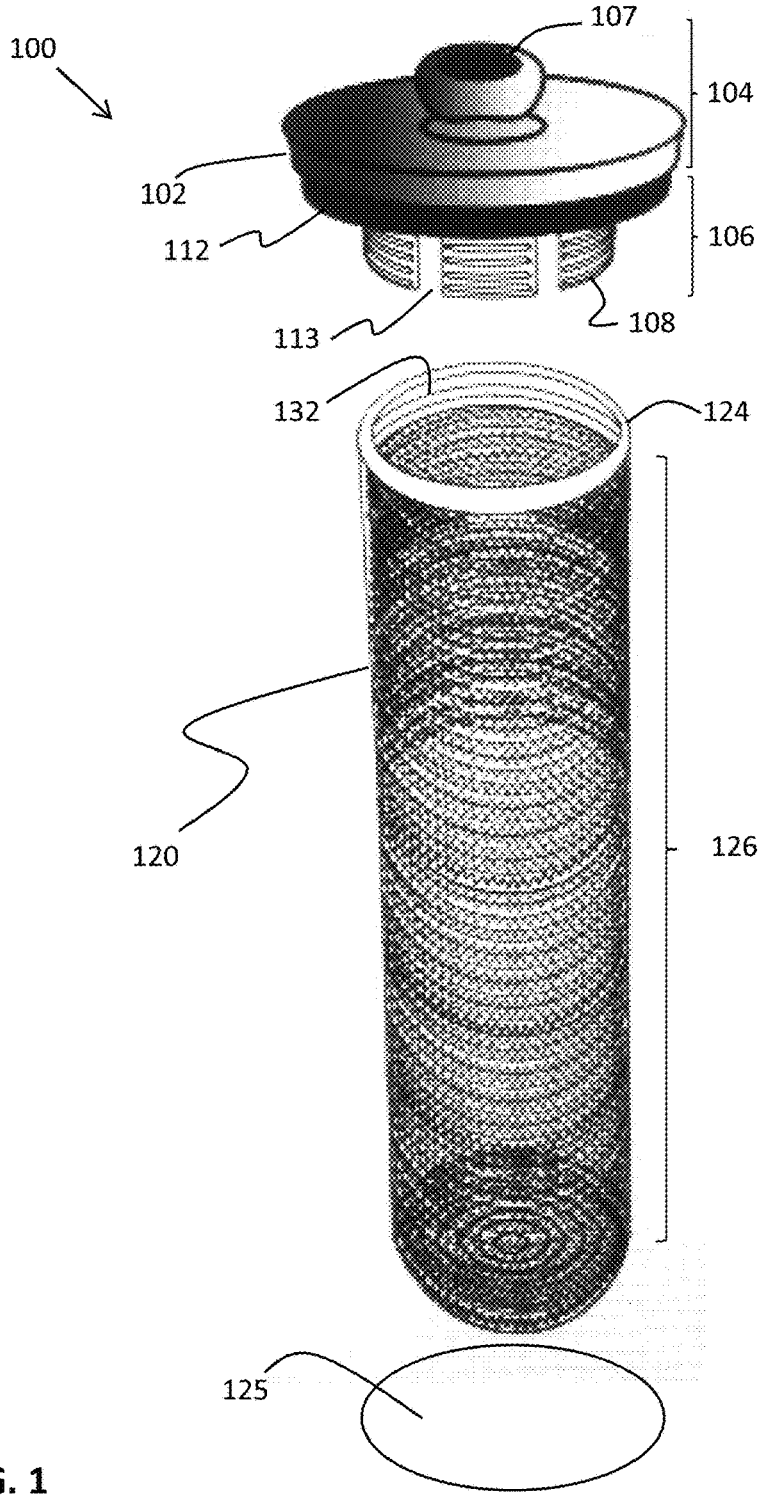
FIG. 1 illustrates an exploded perspective view of an exemplary drain cover assembly that can be used in a sink.

FIG. 1 illustrates a drain cover assembly that may be used with a sink, consistent with an exemplary embodiment. The drain cover assembly 100 includes a drain cover 102 and a basket 120. The drain cover 102 has a top portion 104 and a bottom portion 106. The bottom portion 106 has an outer threading 108 and defines a plurality of openings. In various embodiments, the openings may be slots 113 (e.g., vertical or diagonal) or holes of different shape. For example, all holes may have a shape that is round, triangular, rectangular, etc. These openings 113 allow liquid and debris that is smaller than the openings pass through to the basket 120 below.

The top portion 104 of the drain cover 102 may include a handle 107. In various implementations, the handle 107 may include ridges and may have an upper circumference that is larger than a bottom circumference for better gripping, turning, and pulling, respectively. The handle 107 is configured to threadably connect the bottom portion 106 of the drain cover 102 with the top portion 124 of the basket by rotating the drain cover 102 into the direction of the basket 120. The drain cover assembly 100 can then be removed from the drainage pipe by pulling the handle 107 in a direction opposite the drainage pipe. The drain cover 102 can be separated (i.e., decoupled) from the basket 120 by rotating the drain cover in a counter-clock-wise direction with respect to the basket 120. After removal, the basket 120 can easily be cleaned by dumping out any debris caught.

The top portion 104 of the drain cover 102 has a diameter that is substantially larger than the diameter of the bottom portion 106 of the drain cover 102. In one implementation, there is a gasket (e.g., rubber) 112 located immediately below the top portion 104 of the drain cover 102. The gasket 112 is operative to seal the sink hole 125 of the drainage pipe when the drain cover assembly 100 is lowered further towards the drainage pipe. In various embodiments, the drain cover 102 may be of stainless steel or chrome colored plastic. Other colors, such as gold or any other color and/or suitable material (e.g., to better match the sink décor) are supported as well.

The basket 120 may be cylindrical (as illustrated in FIG. 1), frustoconical, or any other shape that fits inside a drainage pipe through the sink hole 125. The basket 120 has a rigid structure and is configured to be completely immersed in the drainage pipe. In various embodiments, the basket may be of stainless steel, plastic, or any other suitable material. The basket may be a solid piece with a plurality of apertures (i.e., is perforated), a woven mesh, or any other configuration that allows liquid to drain through yet captures debris. In the example of FIG. 1, the height of the basket 120 is approximately 2" and the diameter is approximately 1.25".

In one implementation, the total height from the bottom of the basket 120 to the top surface of the drain cover 102 (i.e., without the handle 107) is approximately 2.75". It is appreciated that the basket 120 is not limited in size but may have any size suitable for its intended application.

The basket 120 includes a top portion 124 and a bottom portion 126. The top portion 124 of the basket 120 is configured to be threadably coupled to the bottom portion 106 of the drain cover 102. Thus, the top portion 124 has an inner threading 132 that is configured to couple with the outer threading 108 of the drain cover 102.

The bottom portion 126 of the basket 120 is configured to allow liquid to seep through but not solid material. Thus, hair, nail clippings, and other solid material may be trapped by the basket 120. When the drain cover 102 is coupled to the basket 120, the basket 120 and the debris therein is hidden from sight.

As discussed in the context of the background section, in many sink designs, drain covers are opened and closed by a user pushing/pulling an external push rod next to the sink faucet. The external push rod is coupled to an internal rod that can open and close the drain cover. The drain cover assembly 100 of FIG. 1 is compatible with existing rod assemblies to open and seal the drainage pipe. In one implementation, the basket 120 is configured to rest on an internal rod in the drainage pipe. Thus, the drain cover assembly 100 can be raised and lowered by engaging the external push rod that is coupled to the sink rod inside the drainage pipe.

Figure 2:
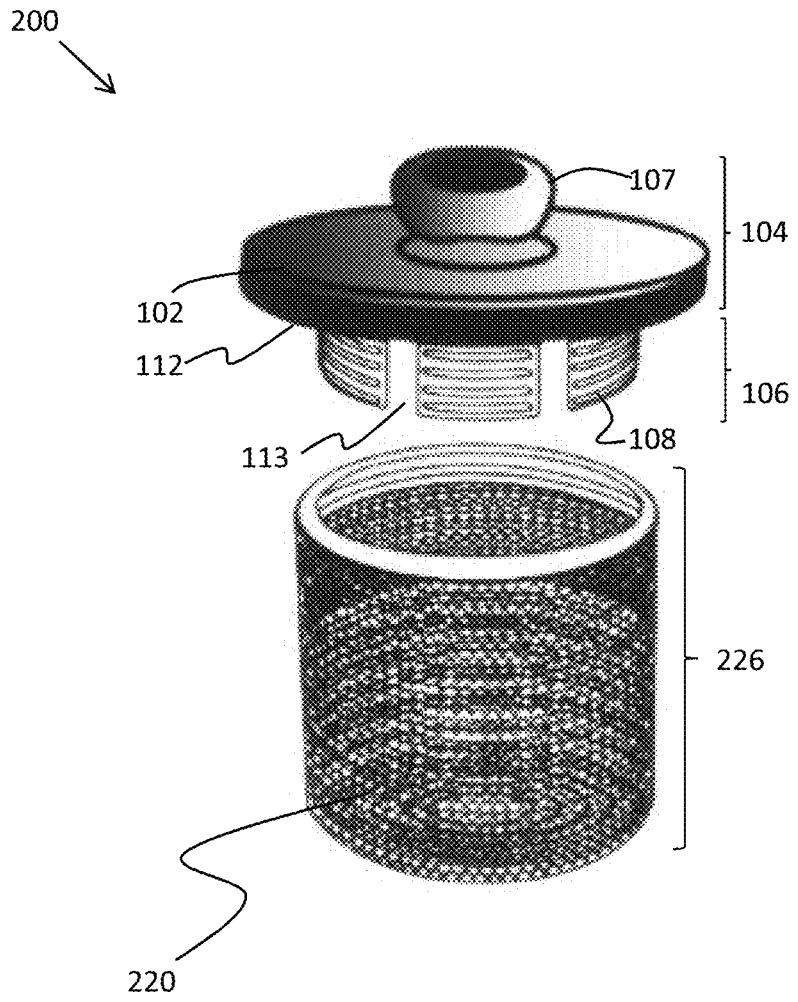
FIG. 2 illustrates an exploded perspective view of an exemplary drain cover assembly that can be used in a tub.

FIG. 2 illustrates an exploded perspective view of an exemplary drain cover assembly that can be used in a tub. The drain cover assembly 200 of FIG. 2 is similar to the drain cover assembly 100 of FIG. 1 and will therefore not be discussed in detail for the sake of brevity. The drain cover assembly 200 includes a drain cover 102 and a basket 220. In one embodiment, the diameter of the bottom portion 106 is approximately 2". In the example of FIG. 2, the height of the basket 220 is approximately 2" and the diameter is approximately 1.75". For example, the drain cover assembly 200 of FIG. 2 may be used in various tubs. The drain cover assembly 200 can be raised and lowered by engaging an external push rod that is coupled to the sink rod inside the drainage pipe of the tub. When closed, the gasket 112 provides a seal with the tub, preventing both liquid and debris to penetrate through the drainage pipe.

Figure 3:
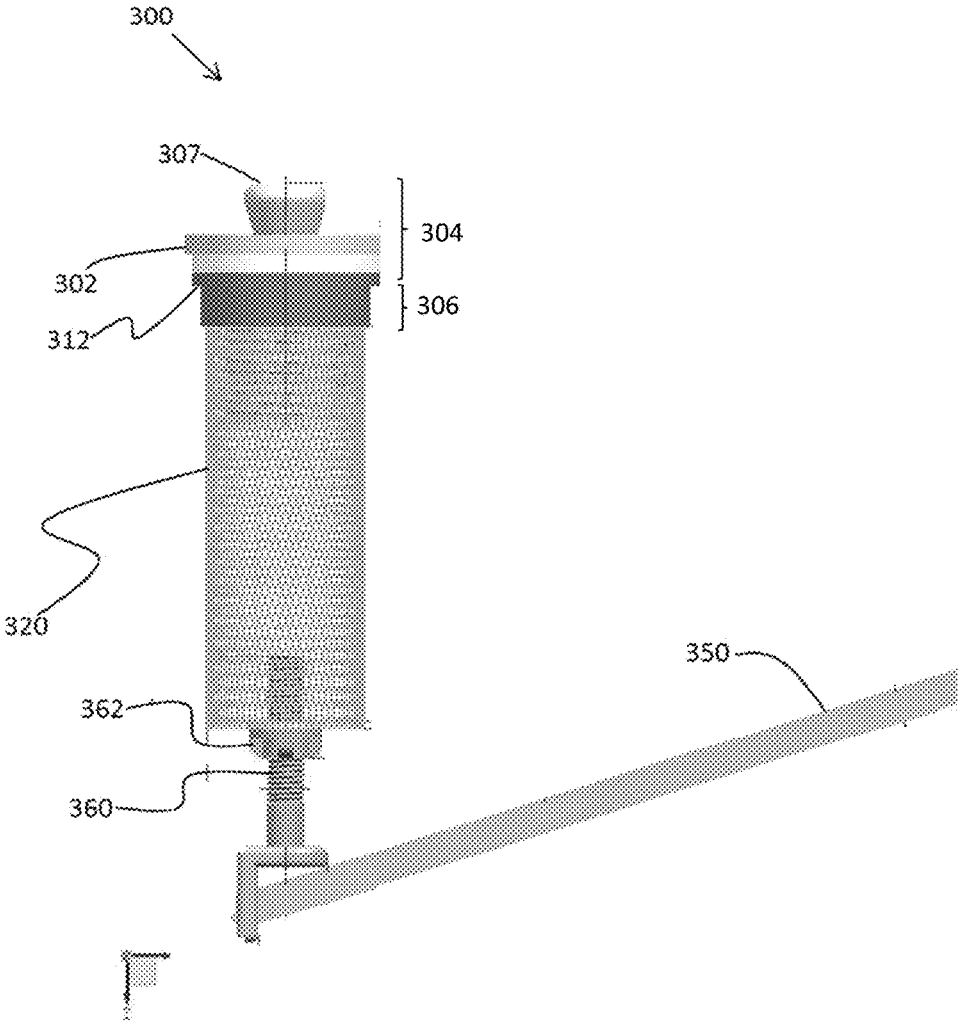
FIG. 3 illustrates a side schematic view of an exemplary drain cover assembly with an adjustable extension element.
Figure 4:
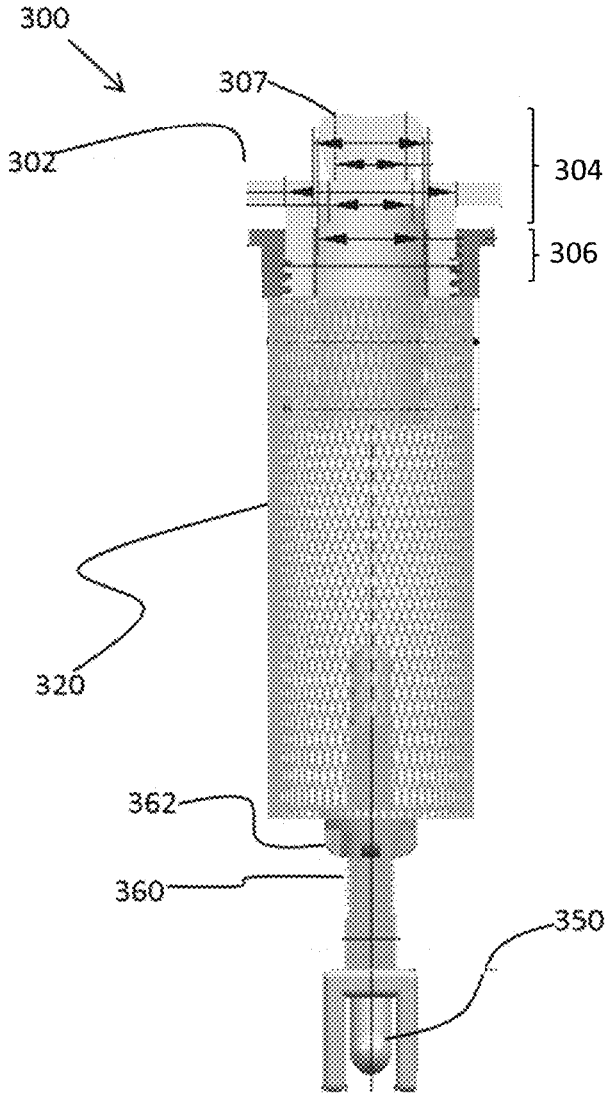
FIG. 4 illustrates a front schematic view of an exemplary drain cover assembly with an adjustable extension element.

FIGS. 3 and 4 illustrate side and front schematic views, respectively, of an exemplary drain cover assembly 300 with an adjustable extension element 360. In the example of FIGS. 3 and 4, the drain cover 302 is coupled to the basket 320. Thus, the bottom portion of the drain cover 302 is threaded to the top portion of the basket (i.e., region 306). In the embodiment of FIGS. 3 and 4, the bottom surface of the basket 320 includes an adjustable extension element 360, which is an externally threaded member that is configured to adjust the total height of the basket 320 such that the basket 320 can couple with the sink rod 350 inside the drainage pipe. For example, the externally threaded member 360 can be extended or shortened by turning either the threaded member 360 or a bolt 362 with respect to the basket 320.

In another embodiment, the drain cover assembly is spring loaded to alternatingly latch to (i) an extended or (ii) to a contracted position each time the drain cover 302 is pressed (e.g., through the handle 307). In this regard, the gasket 312 is allowed to seal the sink hole (not shown) such that there is a seal in the sink or tub.

Figure 5:
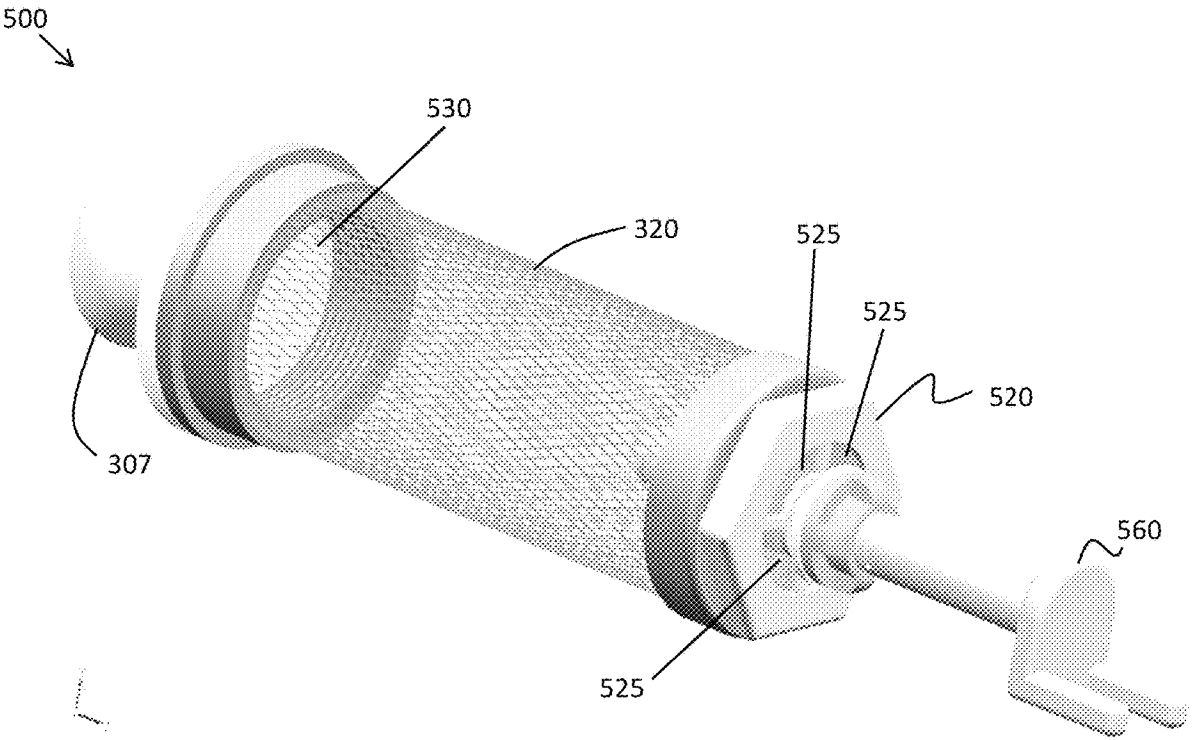
FIG. 5 illustrates a perspective view of an exemplary drain cover assembly with a removable basket bottom.

FIG. 5 illustrates a perspective view of an exemplary drain cover assembly 500 with a removable basket bottom 520. In the embodiment of FIG. 5, the basket bottom 520 can be removed (instead of or in addition to the drain cover 102) for cleaning. For example, the basket bottom 520 may be threadably coupled to the bottom portion of the basket 320. In an exemplary embodiment, the basket 320 includes one or more openings 530 to the interior of the basket 320. For example, the basket 320 may be a solid piece with a plurality of openings or apertures 530 (e.g. is perforated), a woven mesh, or any other configuration that allows liquid to drain through yet captures debris. The basket bottom 520 may be separated (i.e., decoupled) from the basket 320 by rotating the basket bottom in a counter-clock-wise direction with respect to the basket 320. After removal of the basket bottom 520 from the basket 320, debris can easily be removed from the basket 320. In an exemplary embodiment, the removable basket bottom 520 includes one or more openings 525 to the interior of the basket 320. In operation, the openings 525 allow liquid to pass through and exit the interior of the basket 320.

In one embodiment, the basket bottom 520 may include an adjustable extension element 560, which is an externally threaded member that is configured to adjust the total height of the basket 320 such that the basket 320 (including the basket bottom 520) can couple with a sink rod inside the drainage pipe. Thus, the extension element 560 becomes part of the basket 320 and basket bottom 520.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings. Accordingly, the disclosure is intended to cover alternatives, modifications and equivalents, which may be included within the scope of the disclosure.

While the foregoing has been described in conjunction with exemplary embodiments, it is understood that the term "exemplary" is merely meant as an example, rather than the best or optimal.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various embodiments for the purpose of streamlining the disclosure. This method of disclosure is not to be interpreted as reflecting an intention that the claimed embodiments require more features than are expressly recited in each claim. Rather, as the following claims reflect, inventive subject matter lies in less than all features of a single disclosed embodiment. Thus the following claims are hereby incorporated into the Detailed Description, with each claim standing on its own as a separately claimed subject matter.

What is claimed is:

1. A drain cover assembly, comprising:

a drain cover configured to cover a drain; and a basket configured to be inserted in the drain, the basket including:

a first portion coupled to the drain cover;

a second portion including a first plurality of openings to an interior of the basket; and a basket bottom that is removably coupled to the second portion of the basket by a rotatable coupling, the basket bottom including a second plurality of openings to the interior portion of the basket.

2. The drain cover assembly of claim 1, wherein the first portion of the basket is removably coupled to the drain cover.

3. The drain cover assembly of claim 1, wherein the rotatable coupling is a threaded coupling that is configured to threadably couple the basket bottom to the second portion of the basket.

4. The drain cover assembly of claim 1, wherein the drain cover comprises a top portion and a bottom portion, wherein the bottom portion is coupled to the first portion of the basket.

5. The drain cover assembly of claim 4, wherein bottom portion of the drain cover comprises one or more slots to the interior of the basket.

6. The drain cover assembly of claim 4, wherein the bottom portion of the drain cover and the first portion of the basket are configured to be threadably coupled to each other.

7. The drain cover assembly of claim 4, wherein the top portion of the drain cover has a diameter that is larger than a diameter of the bottom portion of the drain cover.

8. The drain cover assembly of claim 4, wherein the top portion of the drain cover comprises a handle configured to facilitate positioning of the drain cover with respect to the drain.

9. The drain cover assembly of claim 1, wherein the basket is configured to be completely inserted in the drain.

10. The drain cover assembly of claim 1, wherein the first plurality of openings of the second portion of the basket are configured to allow liquid to pass through and exit the interior of the basket.

11. The drain cover assembly of claim 1, wherein the first plurality of openings of the second portion of the basket are configured to prevent solid material from exiting the interior of the basket.

12. The drain cover assembly of claim 1, wherein the first plurality of openings of the second portion of the basket are configured to filter out solid material from liquid that is allowed to pass through the first plurality of openings and exit the interior of the basket, the filtered out solid material remaining in the interior of the basket.

13. The drain cover assembly of claim 1, wherein the basket is cylindrical or frustoconical.

14. The drain cover assembly of claim 1, wherein the second portion of the basket is metal.

15. The drain cover assembly of claim 1, wherein the second portion of the basket is plastic.

16. The drain cover assembly of claim 1, wherein the drain cover is configured to selectively switch between:

a contracted position that allows access to the drain; and an extended position that creates a seal between the drain cover and the drain to seal the drain.

17. The drain cover assembly of claim 1, further comprising an extension that extends from the basket bottom away from the second portion of the basket, the extension being configured to engage a sink rod of the drain and adjust a distance between the basket bottom and the sink rod.

18. The drain cover assembly of claim 17, wherein the extension is configured to threadably couple to the basket bottom, the distance between the basket bottom and the sink rod being adjustable using the threadably coupling.

19. A drain cover assembly, comprising:

a drain cover having a first portion and a second portion, the second portion having one or more openings configured to allow liquid and solid material to enter an interior of the drain cover; and a basket configured to be immersed in a drainage pipe, the basket including:

a first portion coupled to the second portion of the drain cover;

a second portion defining an interior of the basket that communicates with the interior of the drain cover to allow the liquid and solid material within the interior of the drain cover to enter the interior of the basket, wherein the second portion includes one or more openings configured to allow the liquid within the interior of the basket to exit the interior of the basket through the one or more openings of the second portion of the basket while filtering out at least a portion of the solid material within the interior of the basket; and a basket bottom removably coupled to the second portion of the basket by a rotatable coupling, the basket bottom including one or more openings to the interior of the basket.

20. The drain cover assembly of claim 19, wherein the one or more openings of the basket bottom are configured to allow the liquid within the interior of the basket to exit the interior of the basket through the one or more openings of the basket bottom while filtering out at least a portion of the solid material within the interior of the basket.

21. A drain cover assembly, comprising:

a drain cover configured to cover a drain;

a basket configured to be inserted in the drain, the basket including:

a first portion coupled to the drain cover;

a second portion including a first plurality of openings to an interior of the basket; and a basket bottom that is removably coupled to the second portion of the basket, the basket bottom including a second plurality of openings to the interior portion of the basket; and an extension that extends from the basket bottom away from the second portion of the basket, the extension being configured to engage a sink rod of the drain and adjust a distance between the basket bottom and the sink rod.

22. A drain cover assembly, comprising:

a drain cover configured to cover a drain, the drain cover including a top portion and a bottom portion; and a basket configured to be inserted in the drain, the basket including:

a first portion threadably coupled to the bottom portion of the drain cover;

a second portion including a first plurality of openings to an interior of the basket; and a basket bottom that is removably coupled to the second portion of the basket, the basket bottom including a second plurality of openings to the interior portion of the basket.

23. The drain cover assembly of claim 5, wherein a size of the one or more slots is adjustable based on a degree in which the bottom portion is inserted into the interior of the basket.

* * * * *